US010986946B1

(12) United States Patent
Sawyer et al.

(10) Patent No.: US 10,986,946 B1
(45) Date of Patent: Apr. 27, 2021

(54) ONE TIME USE BOTTLE

(71) Applicants: Duane Sawyer, York, PA (US); Bob Holmes, York, PA (US)

(72) Inventors: Duane Sawyer, York, PA (US); Bob Holmes, York, PA (US)

(73) Assignee: Quicky Sippy LLC, York, PA (US)

( * ) Notice: Subject to any disclaimer, the term of this patent is extended or adjusted under 35 U.S.C. 154(b) by 0 days.

(21) Appl. No.: 15/683,771

(22) Filed: Aug. 22, 2017

Related U.S. Application Data

(63) Continuation-in-part of application No. 15/231,685, filed on Aug. 8, 2016, which is a continuation-in-part of application No. 14/818,888, filed on Aug. 5, 2015.

(51) Int. Cl.
*A47G 19/22* (2006.01)
*B65D 43/02* (2006.01)
*B65D 47/12* (2006.01)

(52) U.S. Cl.
CPC ..... *A47G 19/2272* (2013.01); *B65D 43/0206* (2013.01); *B65D 47/127* (2013.01); *B65D 2543/0037* (2013.01); *B65D 2543/00046* (2013.01); *B65D 2543/00509* (2013.01)

(58) Field of Classification Search
CPC ..... A47G 19/2272; B65D 47/06; B65D 47/2018; B65D 2543/00046; B65D 2543/00092; B65D 2251/0093; B65D 2543/00296; B65D 51/18
USPC ..... 220/344; 426/115
See application file for complete search history.

(56) References Cited

U.S. PATENT DOCUMENTS 1,865,555 A * 7/1932 Brown ..... B65D 5/72 229/400
4,303,170 A * 12/1981 Panicci ..... A47G 19/2261 215/376
4,756,440 A * 7/1988 Gartner ..... B65D 43/0218 220/254.1
5,542,670 A 8/1996 Morano
2004/0000551 A1* 1/2004 Flink ..... B65D 47/06 220/258.3
2008/0073308 A1* 3/2008 Yousif ..... B65D 51/18 215/232
2008/0110929 A1* 5/2008 Stanley Traasdahl ..... B65D 47/06 222/109
2008/0190945 A1* 8/2008 Milnark ..... A47G 19/2211 220/709
2008/0283537 A1* 11/2008 Smith ..... A47G 19/2272 220/713

(Continued)

*Primary Examiner* — Shawn M Braden
(74) *Attorney, Agent, or Firm* — Muskin and Farmer LLC

(57) ABSTRACT

A hydration system that utilizes a disposable drink container and a leak-resistant cap. The cap can be screwed into the disposable drink container before use. The disposable drink container has a safety foil region with a foil disk having one or more output holes, which is covered with a liner. The user should remove the liner to uncover the output holes and reattach the cap before drinking the liquid in the container. The cap can have a spout section with a leak-resistant section to draw out the liquid. The leak-resistant section can have a curved lip that creates a narrow liquid opening, such that liquid is held in place (does not spill) by surface tension when the system is accidentally inverted or overturned. The cap can also have a sealing ring to create a liquid-tight seal between the cap and the drink container.

9 Claims, 11 Drawing Sheets

(56) References Cited

U.S. PATENT DOCUMENTS

| | | | | |
|---|---|---|---|---|
| 2009/0308831 | A1* | 12/2009 | Anderson | B65D 51/2807 215/227 |
| 2010/0051630 | A1* | 3/2010 | Ellenbecker | B65D 47/06 220/713 |
| 2010/0139670 | A1* | 6/2010 | Lesniak | A61F 5/566 128/862 |
| 2010/0147862 | A1* | 6/2010 | Keefe | A47G 19/2272 220/714 |
| 2011/0101008 | A1* | 5/2011 | Draganic, III | A47G 19/2272 220/703 |
| 2011/0139670 | A1* | 6/2011 | Ciaramitaro | B65D 51/20 206/524.1 |
| 2013/0287904 | A1* | 10/2013 | Tipton | B65D 85/72 426/115 |
| 2014/0203032 | A1* | 7/2014 | Prescott | B65D 43/0212 220/719 |
| 2014/0260117 | A1* | 9/2014 | Farber | A61J 9/00 53/492 |
| 2014/0276383 | A1* | 9/2014 | Frimerman | A47G 19/2266 604/78 |
| 2015/0209706 | A1* | 7/2015 | McCary, Sr. | C02F 1/002 604/514 |
| 2015/0223623 | A1* | 8/2015 | Davis | A47G 19/2272 220/714 |

* cited by examiner

ONE TIME USE BOTTLE

CROSS REFERENCE TO RELATED APPLICATIONS

This application is a continuation in part of U.S. application Ser. No. 15/231,685 which is a continuation in part of U.S. application Ser. No. 14/818,888, both applications of which are incorporated by reference herein in their entireties.

FIELD OF THE INVENTION

The present invention deals with a disposable drink container to be used in conjunction with a reusable or disposable leak-resistant child's cup cap.

BACKGROUND

Since 1846, efforts have been made to create a child's drinking container that enables the child to easily consume the drink while limiting spillage if dropped. See U.S. Pat. No. 4,138. In 1930, a further attempt was made to create a container that would limit the spillage when the bottle was laid on its side. See U.S. Pat. No. 1,865,555. In both cases, the focus was on a container with a baby nipple. The concept of the "SIPPY CUP™" made its first appearance in 1949 with the invention of the weaning cup. See U.S. Pat. No. 2,534,614. This introduced a series of holes or elongated slot for the conveyance of a liquid. One of the purposes for this product was to make it easier for a child to transition from a bottle nipple to drinking from an open glass. Another purpose was to limit the spillage of the liquid being consumed. In 1955, Earl Tupper, of Tupperware fame, patented a "SIPPER SEAL™" system that relied on a conical shape and small slot to minimize the leakage when the container "accidently" was found lying on its side. See U.S. Pat. No. 2,816,548. While there were other inventions that addressed the "weaning" concept style spout, this invention, based on its geometry, had both a spout and leak resistance without depending on a valve body. In the 1960's a child's cup was developed which became the "TOMMEE TIPPEE™" Brand. While not the sippy cup we know today, it was developed to minimize spilling and designed as a child's cup. See U.S. Pat. No. 4,096,966. Shortly after this (1981) another version of the self-righting concept was invented. See U.S. Pat. No. 4,303,170. This one shows a "SIPPY CUP™"-like spout though the patent does not address this.

All of the prior art to this point has been intended to be reusable, not disposable. An invention, filed in 1988, was specified as a disposable closure and claimed to be spill-proof. This was accomplished by a series of small holes to prevent a free flow of liquid, unless flow was initiated by a person sucking on the mouth piece of the closure. See U.S. Pat. No. 4,756,440. The patent does not go into detail as to the science involved to create the spill-proof feature.

Interestingly, the accepted father of the "SIPPY CUP™" is Richard A. Belanger, the inventor of the "SIPSTER CUP™". See U.S. Pat. No. 5,079,013. This patent was licensed to Playtex and variations continue to be made to this day. This system depended on the use of mechanical valves to make a spill-proof cap. There are numerous systems that use a variety of valve configurations and are meant to be used as a reusable product. Some patents address the disposable market and usually involve a throwaway coffee cup or drink cup. One notable patent is intended for the disposable child "SIPPY CUP™" market. See U.S. Pat. No. 8,540,112. This is a LEARNING CURVE™ product called TAKE & TOSS™. The patent goes into great detail as to the science behind the spill-proof or spill-resistant closures that incorporate small holes as the orifice(s) through which liquid flows.

What is needed is a children's hydration system having a disposable child's cup container with a leak-resistant child's cup cap, wherein the child's cup is single use and the leak-resistant child's cup cap is disposable.

SUMMARY OF THE INVENTION

It is an aspect of the present device to provide an improved liquid container which can prevent spills.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which:

FIGS. 10A, 10B, 10C, 10D, 10E, 10F, 10G, 10H, 10I, 10J, 10K, 10L, 10M, 10N, 100, 10P, 10Q are examples of different hole and/or slit configurations in the disk, according to embodiments.

DETAILED DESCRIPTION

The present device can be a lightweight child's cup cap intended to be used with a lightweight disposable drink container. The apparatus described herein are not necessary limited to children and can be used for adults as well. Both the cap and/or the container described herein do not have to be disposable (and either or both can be reusable) although they can be manufactured cheaply enough that it can be practical for them to be disposable in practice.

This cap can be attached to the bottle using screw threads (cap screw threads on the cap which are adapted to screw onto container screw threads on the container). There can be a raised spout on the cap, through which a liquid can be consumed. A sealing ring on the cap can be affixed where the cap connects with the container opening (the mouth). This can provide the seal after a liner has been removed from the container opening.

Within the spout, a protruding member can be affixed at the orifice to regulate the liquid flow. A formed opening can help to prevent unwanted liquid flow, but can increase liquid flow through the orifice when suction from a user's mouth is applied. The increased liquid flow can be made possible by increasing the cross sectional area when compared to a series of holes in the same space. The spill resistance is achieved by varying the gap based on the surface tension of the liquid and closure material composition. Thus, when the cap is placed onto the container (with the liner removed), if the container is spilled (placed horizontally or even upside-down) liquid in the container would not flow out of the opening and thus would not spill. However, the liquid would still flow when a person is drinking through the opening (e.g., applying suction through the opening such as when one drinks out of a straw).

Figure 1A:
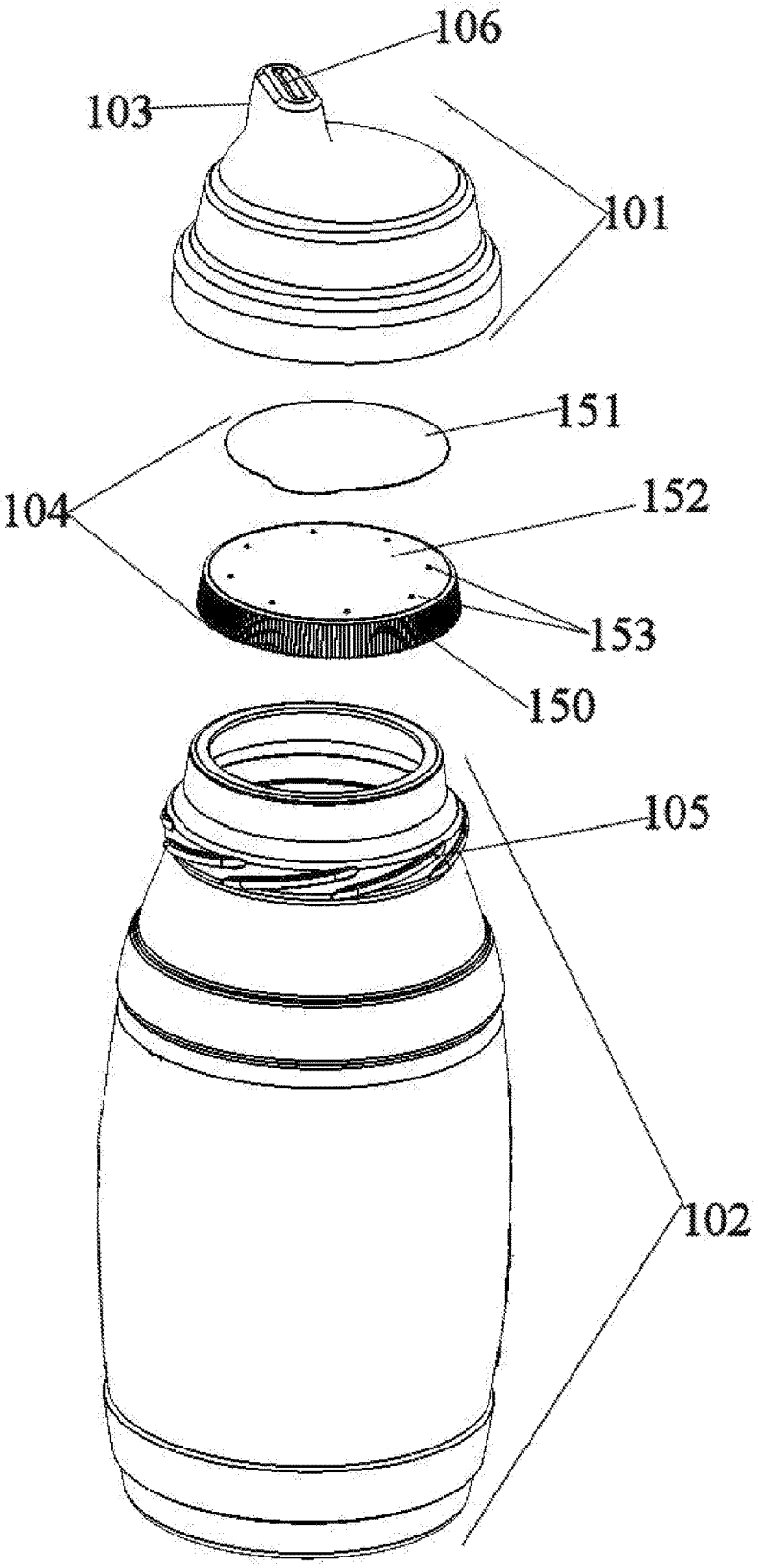
FIG. 1A is an exploded view of a child's hydration system, according to an embodiment.

FIG. 1A is an exploded view of a child's hydration system, according to an embodiment. The children's hydration system is comprised of the drink container 102 and the leak-resistant child's cup cap 101. The drink container 102 and the child's cup cap 101 can be made from plastic, waterproof cup board, biodegradable material, any suitable material, or a combination thereof. The drink container 102 can be completely hollow on the interior in order to maximize the volume of liquid able to fit inside the drink container 102. The drink container 102 can have a storage foil region 104 which includes liner 151 which can be placed on top of the foil disk 152 sealing holes 153 in the foil disk 152 (the liner 151 is typically attached to the foil disk 152 by an adhesive (e.g., non-toxic glue or other adhesive) so the liner 151 can be easily removed (by pulling) from the foil disk 152 while the foil disk 152 remains attached to the container 102). The foil disk 152 can be made of aluminum foil (or other suitable material) and has holes 153 and ridges 150 on the outer perimeter of the foil disk 152. The ridges 150 are tightly formed around the mouth of the container 102 in order to secure the foil disk 152 on the container 102 (but the ridges 150 are still malleable and can be removed by a person with enough force). The drink container 102 can have container screw threads 105, which can be used to secure the child's cup cap 101 to the drink container 102 by screwing them on to cap screw threads which are adapted to fit (screw) onto the container screw threads. When the container screw threads 105 are screwed onto the cap screw threads the seal would be tight so as to prevent any leakage of liquid from inside the container and cap. Note that there are four separate parts that all attach together (the cap 101, container 102, liner 151, and foil disk 152) to form the entire apparatus. Typically all parts of the cap 101 are integrally formed (e.g., formed as one piece), and the container 102 is also integrally formed (e.g., formed as one piece), as well as the foil disk 152 and the liner 151 are both each one piece.

The leak-resistant child's cup cap 101 can have a spout section 103, which can be elongated from the body of the cap 101 to allow for ease of drinking. The spout section 103 can be topped with a slit-like opening 106 (as described herein) that can allow liquid to pass out of the drink container 102, through the child's cup cap 101, and into the user's mouth. Both the drink container 102 and the child's cup cap 101 can be metal, plastic, paper, or other composite material.

Figure 1B:
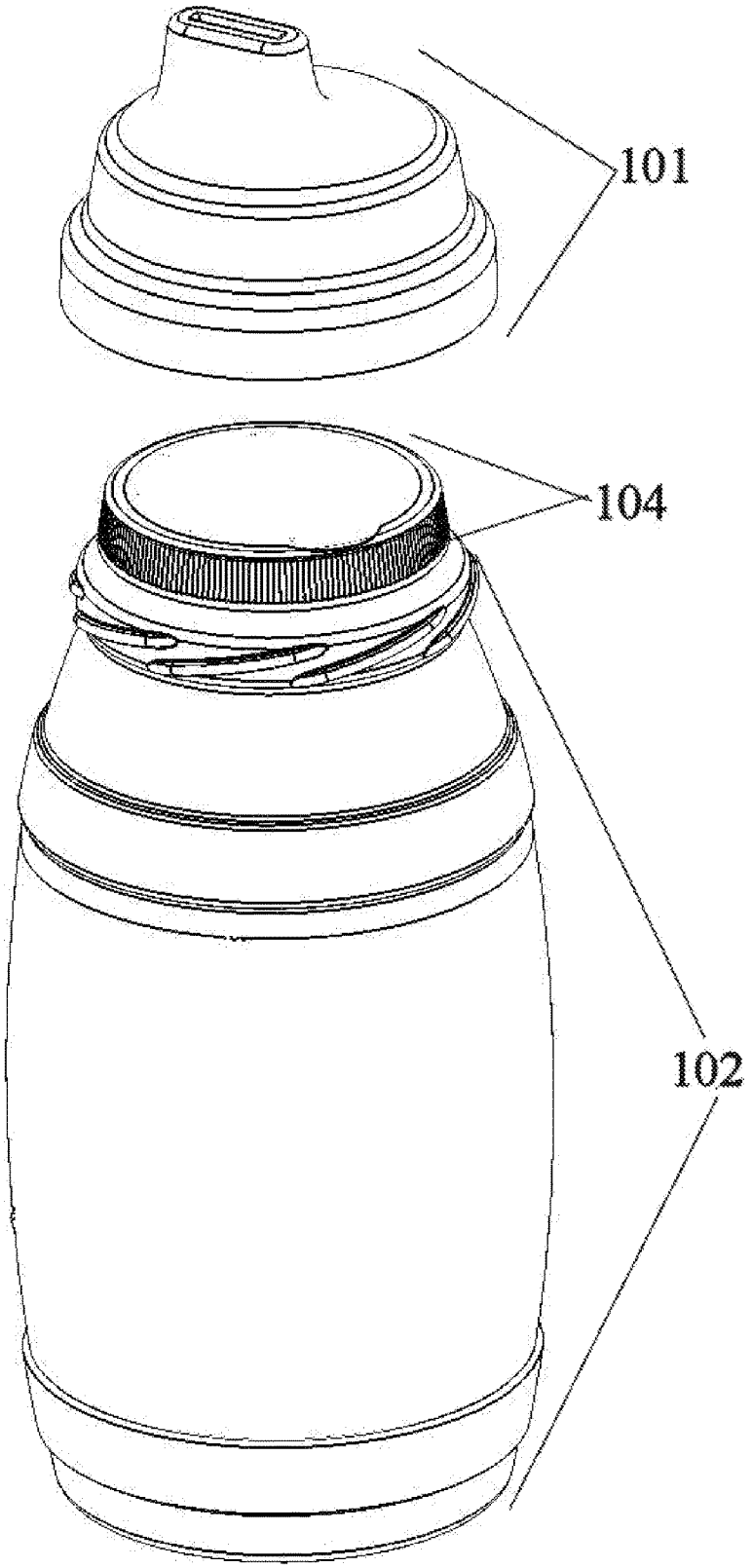
FIG. 1B is a perspective view of a child's hydration system, according to an embodiment.

FIG. 1B is a perspective view of a child's hydration system, according to an embodiment. In this view, the storage foil region 104 is attached to the drink container 102 such that the storage foil region 104 prevents the loss of liquid from the drink container 102. The storage foil region 104 comprises a liner which completely prevents the liquid from flowing out of the container (and thus needs to be peeled off before the liquid is consumed). The storage foil region 104 also comprises a foil disk under the liner which has output holes which permit the flow of liquid but restrain the free flow. Thus, if the container has the liner removed but the foil disk present (which is attached to a mouth of the container) and the container is turned sideways (or upside down), the liquid may flow slowly or not at all. However, the output holes do not prevent the user from drinking the liquid inside the container through the output holes using suction from the user's mouth.

Figure 2:
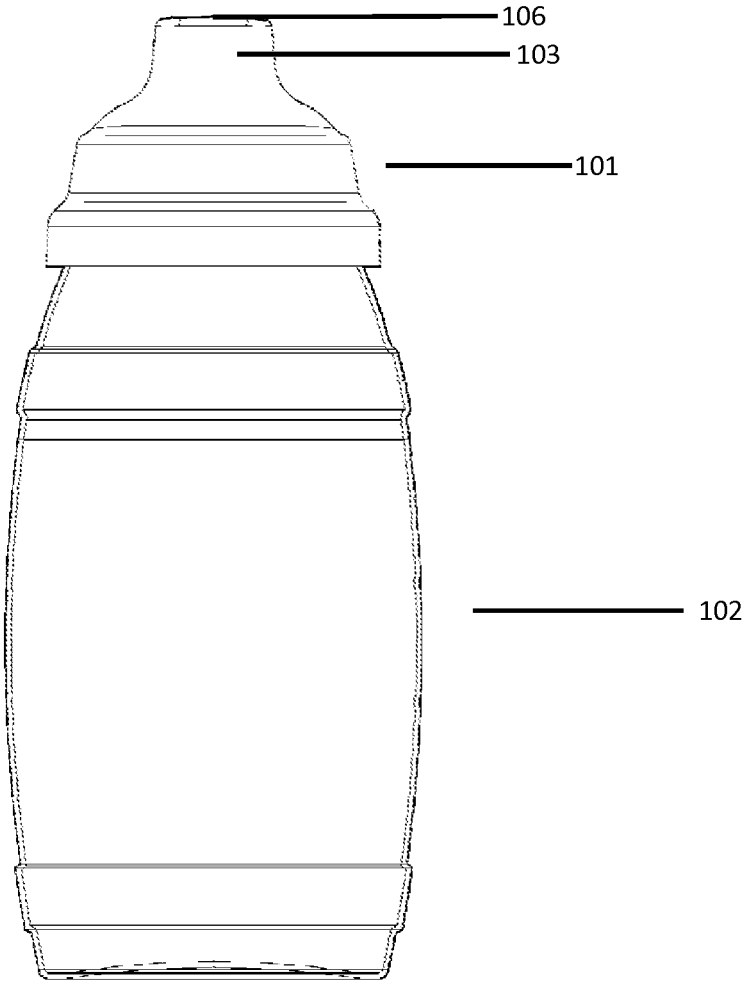
FIG. 2 is a perspective view of a child's hydration system, according to an embodiment.

FIG. 2 is a perspective view of a child's hydration system having a drink container 102 with a leak-resistant child's cup cap 101, according to an embodiment. The child's cup cap 101 can attach to the drink container 102 by screwing the child's cup cap 101 onto the screw threads (not shown) molded into the drink container 102. When attached, the child's cup cap 101 can cover both the screw threads (not shown) and the storage foil region (not shown), creating a seal such that a liquid can be drawn from the drink container 102 when a suction force is applied by a user's mouth.

Figure 3A:
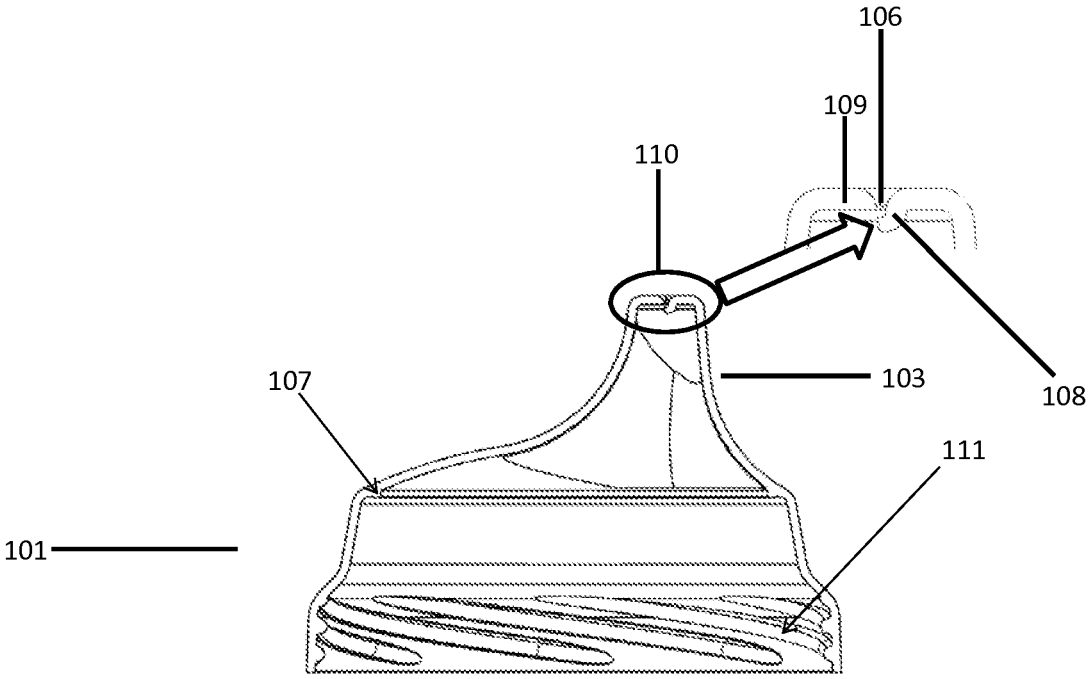
FIG. 3A is a cross section view of a leak-resistant child's cup cap, according to an embodiment.

FIG. 3A is a cross section view of a leak-resistant child's cup cap 101, according to an embodiment. To attach to the drink container (not shown), the child's cup cap 101 can have a set of receiving screw threads 111 (also referred to as cap screw threads) that can correspond to the screw threads on the drink container (container screw threads). The child's cup cap 101 can have a sealing ring 107, which can be used to create an airtight seal between the child's cup cap 101 and the drink container 102 when the two are attached. The sealing ring 107 can be made of rubber, plastic, a composite thereof, or any suitable material.

At the tip of the spout section 103 can be the leak-resistant section 110, which comprises an opening 106, a curved lip 108, and a straight lip 109. The curved lip 108 is arcuate in shape, which can create a narrow liquid channel. The narrowness of the liquid channel can utilize the high surface tension of liquid to block the release of liquid if no suction force is present. This allows for the child's cup cap 101, when attached to a drink container 102 having liquid, to prevent unwanted spillage of the liquid if the apparatus is accidentally tipped on its side or inverted. To overcome the surface tension force, the user can apply a sufficient suction force to draw liquid through the liquid channel, around the curved lip 108, and into the user's mouth through the opening 106. The leak-resistant section needs no moving parts or valves. While shown as an ellipse, the opening 106 can also be rectangular in shape.

Figure 3B:
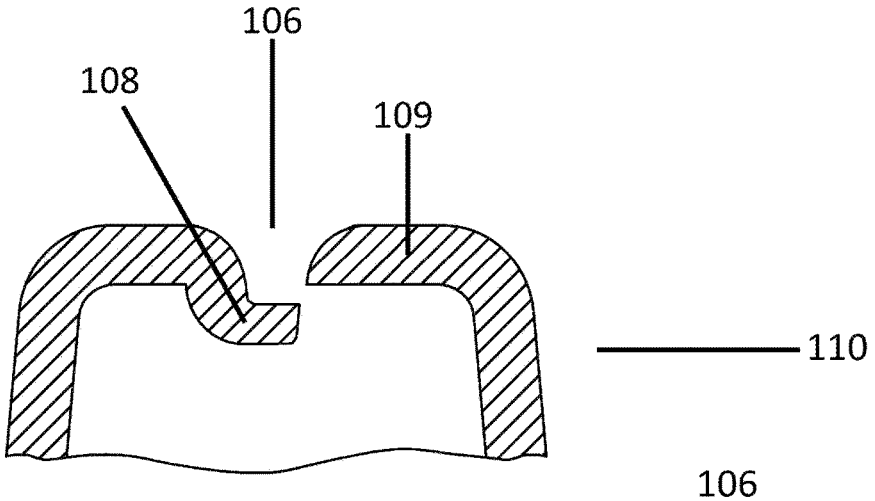
FIG. 3B is a cross section view of a leak-resistant section, according to an alternate embodiment.

FIG. 3B is a cross section view of a leak-resistant section, according to an alternate embodiment. To accommodate liquids with varying viscosities, the opening 106 size can be varied. In this embodiment, the distance between the curved lip 108 and the straight lip 109 has been lengthened in a horizontal direction. Alternatively, the distance can be shortened in the same direction. For instance, the distance could be narrowed for a liquid with a low viscosity, such as water, while the distance could be increased for a liquid with a higher viscosity, such as milk. Thus, one apparatus (cap attached to container) can have a larger such distance if the liquid in the container is milk while another such apparatus (cap attached to container) would have a relatively smaller such distance if the liquid in the container is water (which is thinner than milk). In this way, the opening is configured based on the properties of the liquid such that the liquid would not flow if the apparatus (cap plus container) is turned sideways or upside down but liquid can still easily flow when drank through the opening using standard suction.

Figure 3C:
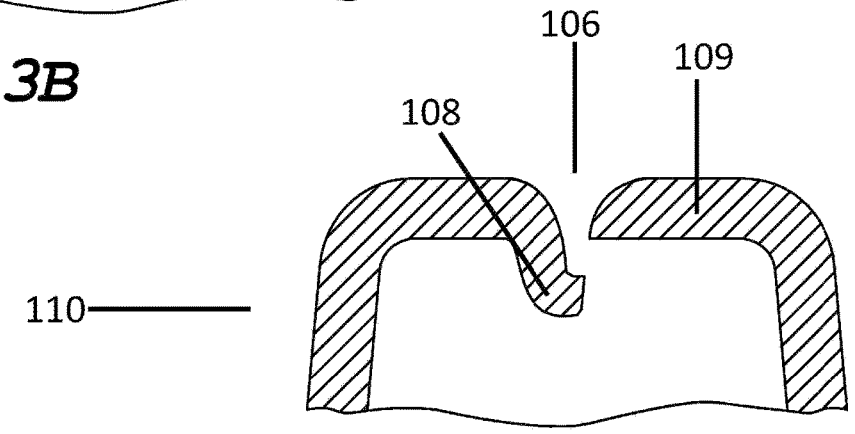
FIG. 3C is a cross section view of a leak-resistant section, according to an alternate embodiment.

FIG. 3C is a cross section view of a leak-resistant section, according to an alternate embodiment. To accommodate liquids with varying viscosities, the opening 106 size can be varied. In this embodiment, the distance between the curved lip 108 and the straight lip 109 has been lengthened in a vertical direction. Alternatively, the distance can be shortened in the same direction. For instance, the distance could be narrowed for a liquid with a low viscosity, such as water, while the distance could be increased for a liquid with a higher viscosity, such as milk.

Figure 3D:
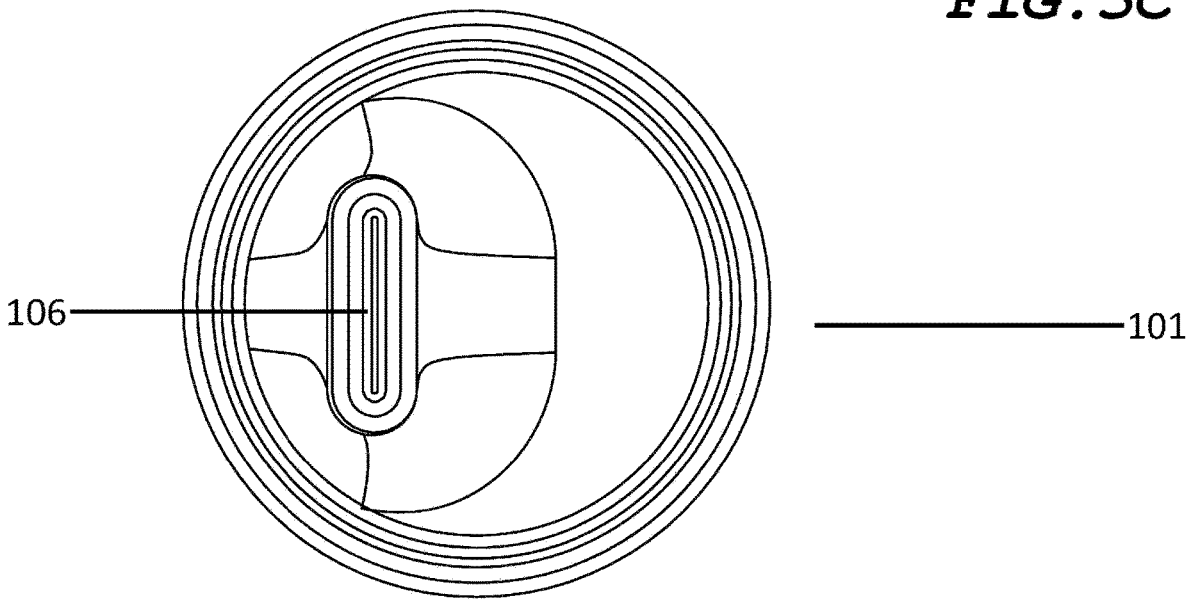
FIG. 3D is a top view of a leak-resistant child's cup cap, according to an alternate embodiment.

FIG. 3D is a top view of a leak-resistant child's cup cap, according to an alternate embodiment. To accommodate liquids with varying viscosities, the opening 106 size can be varied. In this embodiment, the opening 106 can be stretched lengthwise to increase its size. Alternatively, the opening 106 can be shortened in the same direction. For instance, the distance could be narrowed for a liquid with a low viscosity, such as water, while the distance could be increased for a liquid with a higher viscosity, such as milk.

Each of the structural variations described in FIGS. 3B, 3C, and 3D can be applied separately or in conjunction. For example, the vertical and horizontal distance between the curved lip 108 and the straight lip 109 could be increased at the same time, while the length of the opening 106 could remain the same.

Figure 4:
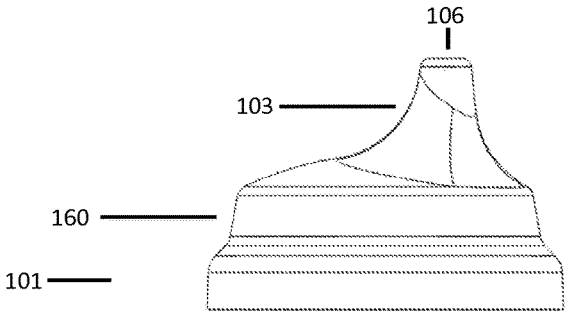
FIG. 4 is a side view of a leak-resistant child's cup cap, according to an embodiment.

FIG. 4 is a side view of a leak-resistant child's cup cap 101, according to an embodiment. Above the receiving (cap) screw threads (not shown) can be the storage foil region receiving section 160, which can be the opposite impression of the storage foil region (not shown) on the drink container (not shown), meaning that when attached, the storage foil region can nestle snugly into the storage foil region receiving section 160.

Figure 5:
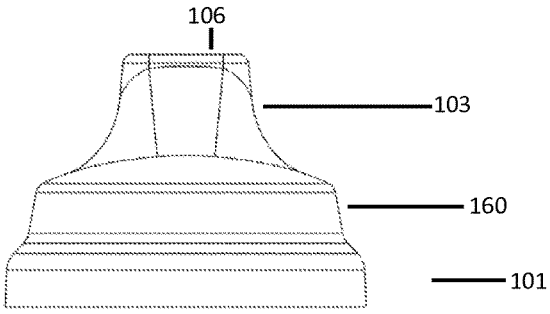
FIG. 5 is a front view of a leak-resistant child's cup cap, according to an embodiment.

FIG. 5 is a front view of a leak-resistant child's cup cap 101, according to an embodiment.

Figure 6:
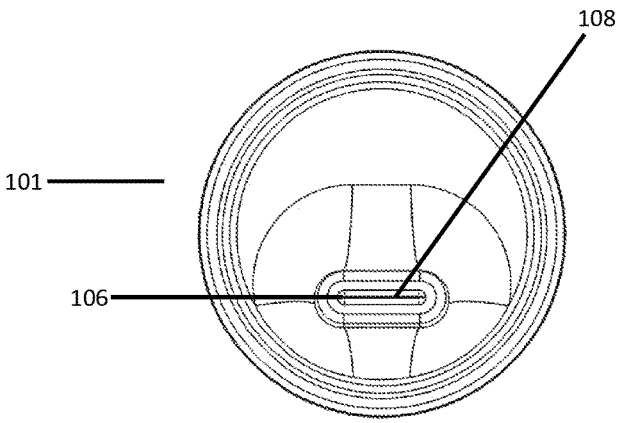
FIG. 6 is a top view of a leak-resistant child's cup cap, according to an embodiment.

FIG. 6 is a top view of a leak-resistant child's cup cap 101, according to an embodiment. Through the opening 106, the curved lip 108 can be seen. The curved lip 108 prevents a direct passage of liquid from the drink container (not shown) into the mouth of the user, preventing unwanted leakage if the container is overturned.

Figure 7:
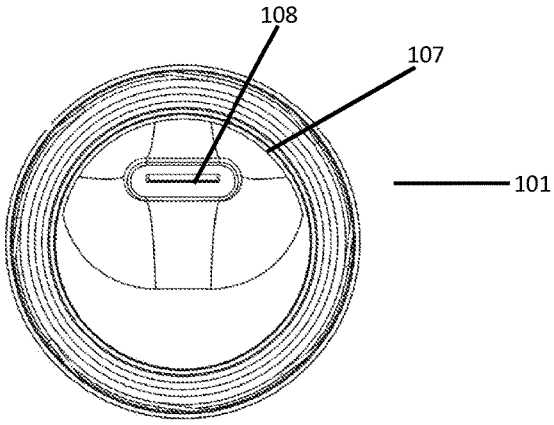
FIG. 7 is a bottom view of a leak-resistant child's cup cap, according to an embodiment.

FIG. 7 is a bottom view of a leak-resistant child's cup cap 101, according to an embodiment. The sealing ring 107 is a complete circle within the child's cup cap 101, such that a complete seal can be achieved when the child's cup cap 101 is attached to the drink container (not shown). The curved lip 108 occludes the opening (not shown) in this view.

Figure 8:
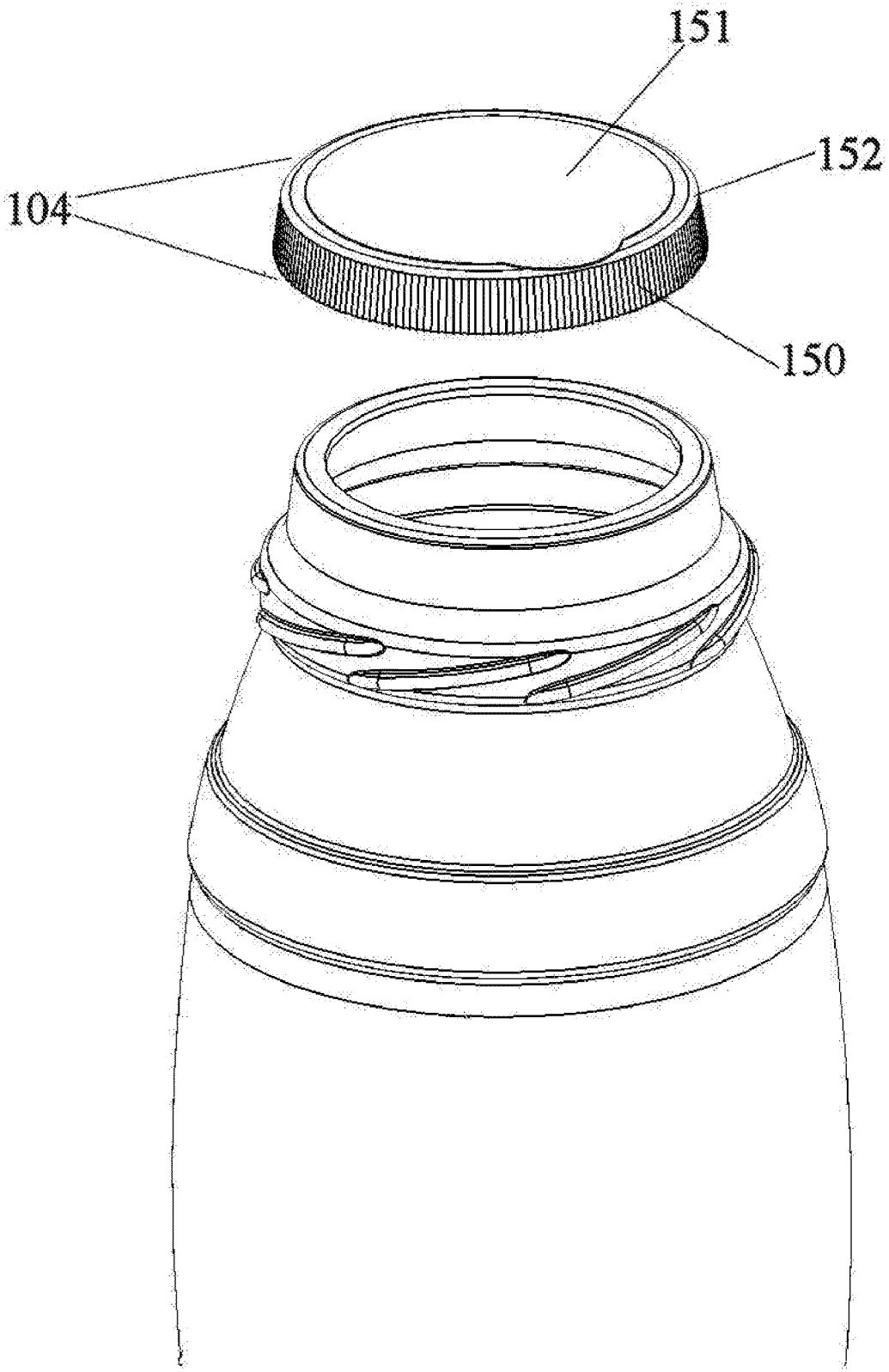
FIG. 8 is a perspective view of a storage foil for a drink container, according to an embodiment.

FIG. 8 is a perspective view of a storage foil region 104 for a drink container, according to an embodiment. The storage foil region 104 can comprise the foil disk 152 having ridges 150, and the liner 151. The liner 151 can be made from aluminum foil, plastic, vinyl, or any material impermeable to liquid. The liner 151 can be removably attached to the foil disk 152 using an adhesive (e.g., such as a non-toxic glue), such that the liner 151 covers and seals all output holes (not shown) which can be pre-formed on the foil disk 152. Once removed from the foil disk 152 (typically by pulling), the liner 151 typically would not easily reattach to the foil disk 152 without using more adhesive. The liner can easily be removed by a user by simply pulling the liner off of the foil disk 152. The ridges 150 on the foil disk 152 can allow for a snug fit with the child's cup cap (not shown) when attached. When the user desires access to the liquid within the drink container, the user can peel off the liner 151, exposing the output holes (not shown), which can then allow liquid to pass out of the drink container into the child's cup cap. The foil disk 152 can be made of foil, plastic, metal, paper, or composite material. The liner 151 can be a thin sheet of aluminum, plastic, paper, vinyl, foil, or other metal or composite material.

Figure 9:
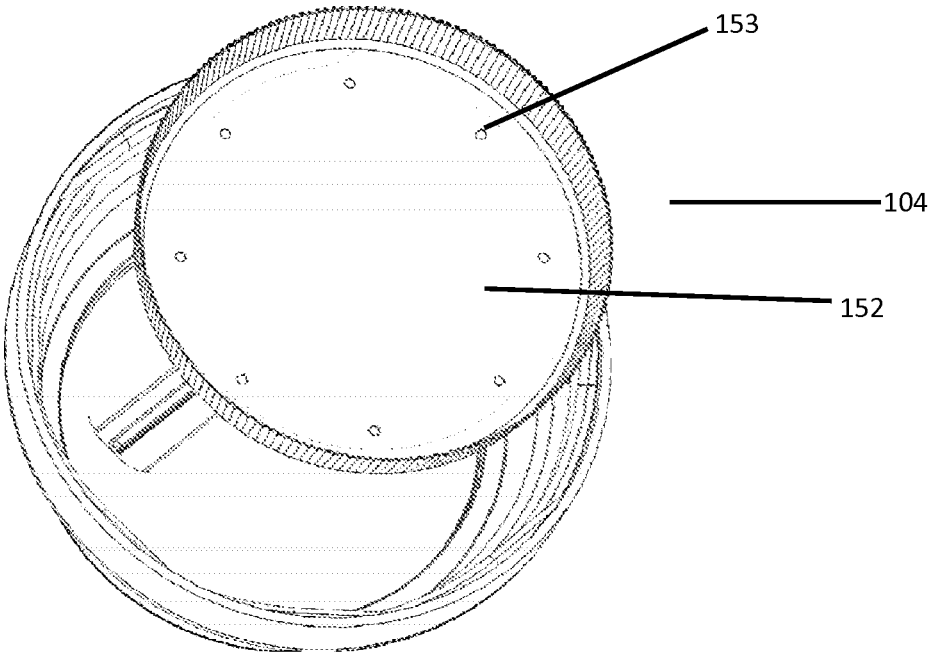
FIG. 9 is an inner view of a drink container, according to an embodiment.

FIG. 9 is an underside view of a foil region 104, according to an embodiment. The foil disk 152 can have one or more output holes 153, which can be prefabricated with the foil disk 152. Alternatively, the output holes 153 can be drilled into a preformed foil disk 152. The output holes 153 can be of a sufficient diameter to admit liquid when a suction force is applied, but not so large such that liquid leaks out if the apparatus is knocked on its side or inverted. The output holes 153 can be oriented around the perimeter of the foil disk (as illustrated) or in any other configuration.

If a user wishes to reuse the container after the liquid therein has all been consumer, the user can remove the foil disk 152 and wash the container out and then fill it with a new liquid of their choice. The cap can then be screwed back onto the container. While this container and cap now does not have the benefit of the foil disk (and its restriction of fluid flow) it is still usable.

FIGS. 10A, 10B, 10C, 10D, 10E, 10F, 10G, 10H, 10I, 10J, 10K, 10L, 10M, 10N, 100, 10P, 10Q are examples of different sealing holes 153 which can include holes and/or slits configured in the disk, according to embodiments. The holes and/or slits in the disk can also be referred to as passages.

Figure 10A:
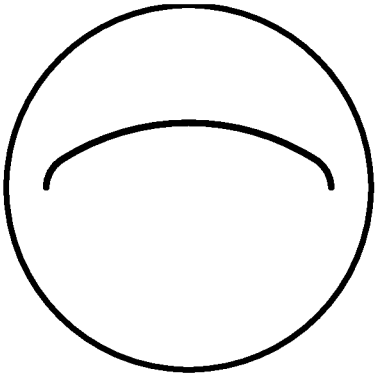
Figure 10B:
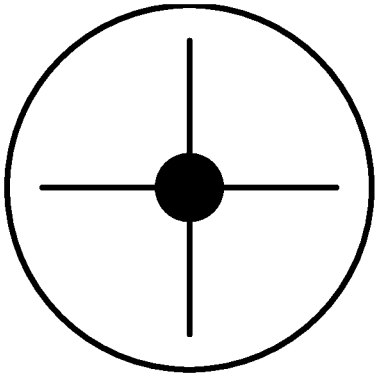
Figure 10C:
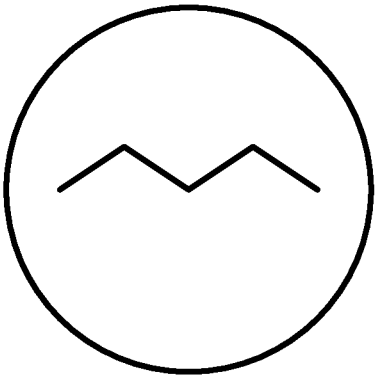
Figure 10D:
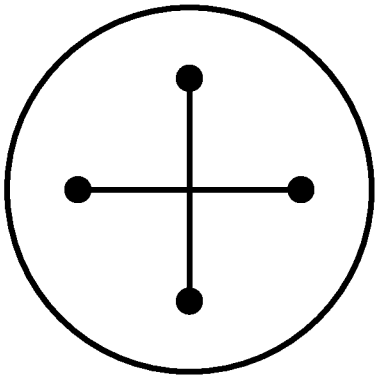
Figure 10E:
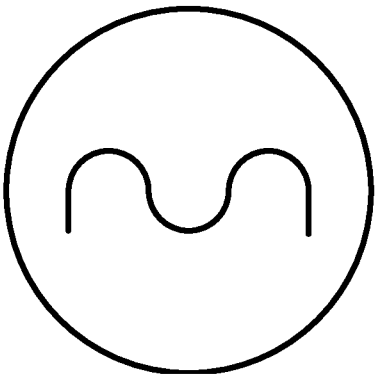
Figure 10F:
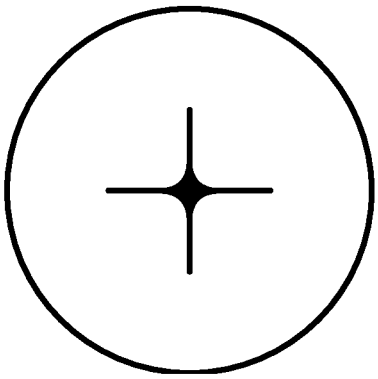
Figure 10G:
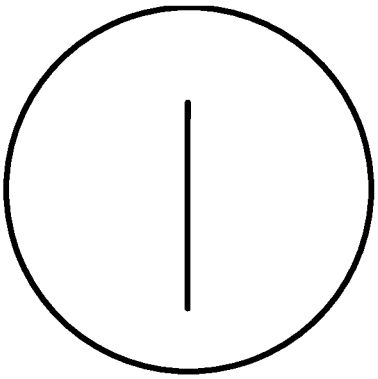
Figure 10H:
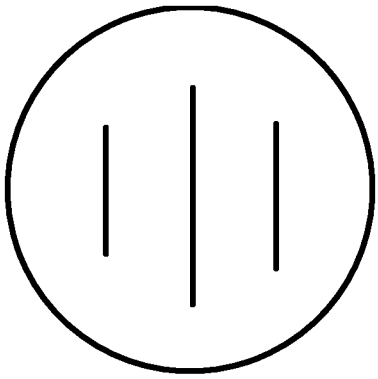
Figure 10I:
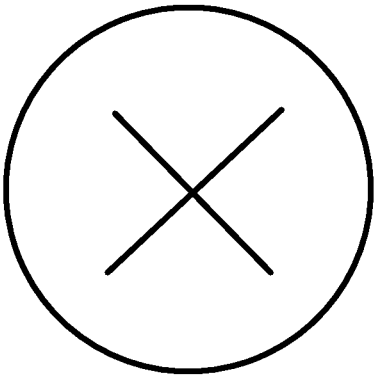
Figure 10J:
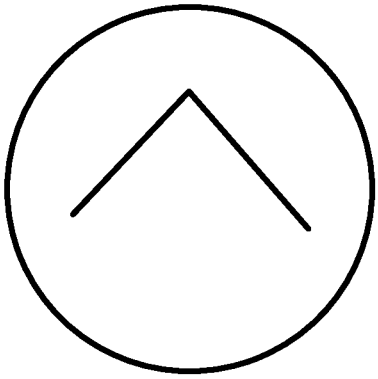
Figure 10K:
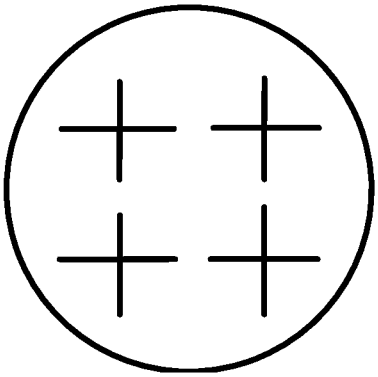
Figure 10L:
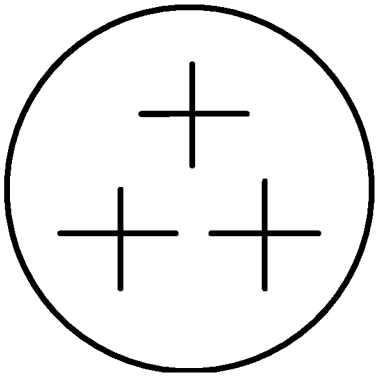
Figure 10M:
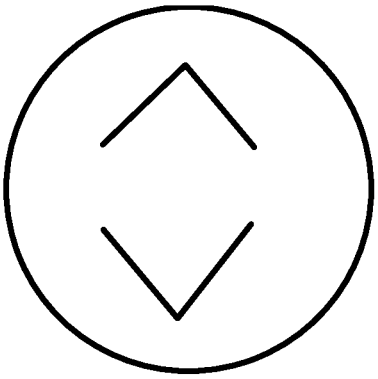
Figure 10N:
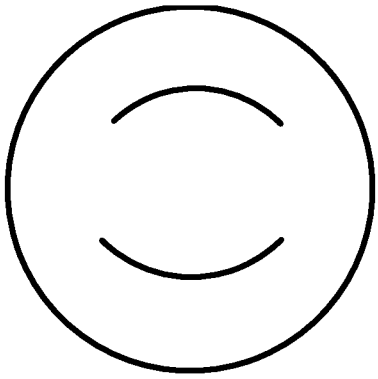
Figure 10O:
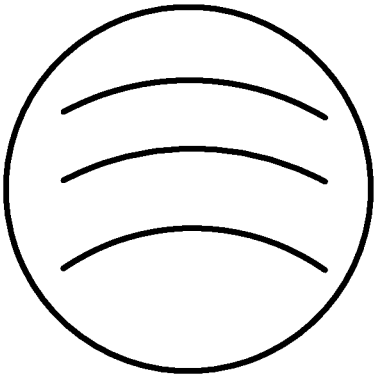
Figure 10P:
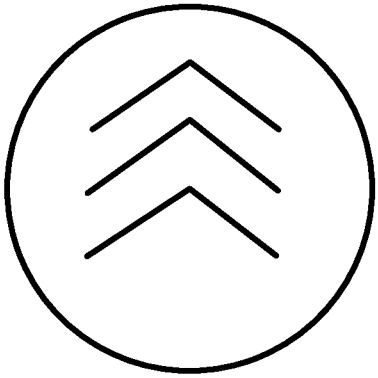
Figure 10Q:
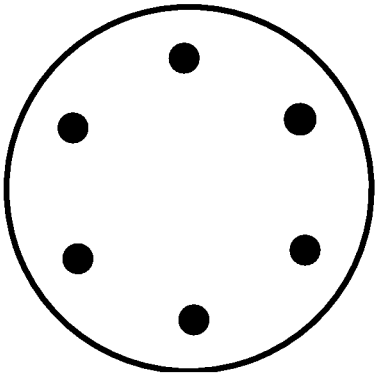

FIG. 10A shows a curved slit. FIG. 10B shows a combination of slits and a hole, as four slits lead to a center hole. FIG. 10C shows a series of connected slits. FIG. 10D shows a configuration of four holes and four slits. FIG. 10E shows a curves slit. FIG. 10F shows four slits leading to a center hole. FIG. 10G shows a single slit. FIG. 10J shows multiple slits. FIG. 10I shows two slits in an 'X' pattern. FIG. 10J shows two slits in a 'V' pattern. FIG. 10K shows four 'plus sign' pattern slits. FIG. 10L shows three 'plus sign' pattern slits. FIG. 10M shows two 'v' pattern slits. FIG. 10N shows two curved slits. FIG. 10O shows three curved slits. FIG. 10P shows three 'v' shaped slits. FIG. 10Q shows six holes arranged at a perimeter. Note that all of these patterns/configurations are merely examples and any other such combination of slits and/or holes can be used on the disk. The disk is covered by the liner and once the liner is peeled off, the liquid will flow through the disk via the hole and/or slit configuration in the disk. The liner could be made of one or more layers (e.g., 2, 3 or more).

Note that the disk 152 does not have to be made of foil but can be made of any other material, such as foam, Polyurethane laminate (PUL), or any other suitable material. The liner 151 can be made of PUL, foil, foam, or any other suitable material. The material of the disk and liner can be made of any combination, for example, the disk 152 can be PUL, foam, foil, or any other material and the liner 151 can be PUL, foam, foil, or any other material.

The disk 152 will have sealing holes 153 which can be slits, holes, or a combination of slits and holes. The liner 151 can be kiss sealed to the disk 152 using laser technology, heat, induction, sonic weld technologies, or any other sealing method. The disk 152 is then placed into the cap 101 during the injection mold process. When the cap 101 is placed on the bottle, the outer perimeter of the disk 152 is sealed to the bottle using heat, induction or radio waves. The user will remove the cap 101, and pull the liner 151 from the disk 152 which was sealed to the disk 152. This will expose the disk 152 that has the sealing holes 153 that act as primary mechanism to slow down flow of fluids moving towards the opening 106.

Some configurations of sealing holes 153 can act is a flapper valve. Using a liner 151 made of foam (which provides resilient flexibility properties with some memory to return to the pre-flexed condition) may work better than using a liner made of foil. For example, if the sealing holes 153 in the disk 152 are in the configuration of a plus sign such as FIG. 10B, 10D, 10F, 10I, 10K, 10L (although other configurations can be used for the "flapper valve" as well), when the liner 151 is removed exposing the sealing holes 153, then when the cap 101 is placed back on the bottle and a child sucks on the lid, each corner of the plus sign (the sealing hole 153 configuration) would lift up and allow fluid to pass. When the sucking force stops, the corners should return back to their original position if the material is stiff enough, thereby reducing the chance of fluid unintentionally (with no sucking force) flowing out of the opening 106.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The many features and advantages of the inventive concept are apparent from the detailed specification and, thus, it is intended by the appended claims to cover all such features and advantages of the concept that fall within its true spirit and scope. Further, since numerous modifications and changes will readily occur to those skilled in the art, it is not desired to limit the inventive concept to the exact construction and operation illustrated and described, and accordingly all suitable modifications and equivalents may be resorted to, falling within the scope of the inventive concept.

What is claimed is:

1. An apparatus, comprising:

a container comprising a liquid and container screw threads on an end of the container;

a disk covering a mouth of the container, the disk comprising passages, the disk being removable from the mouth of the container; and a removable liner covering the disk and the passages, the removable liner configured to peel off the disk; and a cap covering the disk, wherein the disk is made out of foam, and the passages comprise slits, and the passages and disk are configured such that the passages operate as a flapper valve such that when a sucking force is applied through the cap a portion of the disk lifts allowing the liquid to pass, and the slits and disk are also configured such that when the sucking force stops the portion of the disk returns to its original position.

2. The apparatus recited in claim 1, wherein the disk further comprises one or more ridges.

3. The apparatus recited in claim 1, further comprising:

the cap comprising cap screw threads screwed onto the container screw threads and a spout section having an opening for the liquid, wherein the opening is a slit.

4. The apparatus as recited in claim 3, the spout section further comprising a leak-resistant section comprising a curved lip and a straight lip, the curved lip and the straight lip being located in proximity to form the opening therein.

5. The apparatus as recited in claim 4, wherein narrowness of the slit is configured to prevent the liquid from flowing through the slit due to surface tension without pressure being applied to the container.

6. The apparatus as recited in claim 3, wherein the cap further comprises a sealing ring.

7. The apparatus as recited in claim 1, further comprising:

a cap comprising a spout section further comprising a curved lip and a straight lip configured to form an opening which forms a slit, the cap configured to fit onto the container; and a sealing ring connected to the spout section.

8. The apparatus as recited in claim 7, further comprising:

cap screw threads on the cap;

the container comprising container screw threads screwed onto the cap screw threads.

9. The apparatus as recited in claim 7, wherein proximity of the curved lip and the straight lip is adjusted according to a viscosity of the liquid in the container.

* * * * *